US007581898B2

(12) United States Patent
Gueret

(10) Patent No.: US 7,581,898 B2
(45) Date of Patent: Sep. 1, 2009

(54) DEVICE FOR APPLYING A SUBSTANCE

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 536 days.

(21) Appl. No.: 11/171,213

(22) Filed: Jul. 1, 2005

(65) Prior Publication Data

US 2006/0002758 A1 Jan. 5, 2006

Related U.S. Application Data

(60) Provisional application No. 60/587,489, filed on Jul. 14, 2004.

(30) Foreign Application Priority Data

Jul. 1, 2004 (FR) ..... 04 07319

(51) Int. Cl.
*A46B 11/00* (2006.01)

(52) U.S. Cl. ..... 401/129; 401/126; 401/122; 132/218; 132/219

(58) Field of Classification Search ..... 401/121, 401/122, 118, 129, 268, 269, 126; 132/218, 132/219
See application file for complete search history.

(56) References Cited

U.S. PATENT DOCUMENTS

| | | | |
|---|---|---|---|
| 4,422,986 | A | 12/1983 | Cole |
| 4,660,582 | A | 4/1987 | Taylor |
| 5,086,793 | A | 2/1992 | Kingsford |
| 6,343,607 | B1 | 2/2002 | Gueret |
| 6,412,496 | B1 | 7/2002 | Gueret |
| 6,530,950 | B1 | 3/2003 | Alvarado et al. |
| 6,546,937 | B2 | 4/2003 | Gueret |
| 6,581,610 | B1 | 6/2003 | Gueret |
| 2002/0023658 | A1 | 2/2002 | Gueret |
| 2005/0034740 | A1 | 2/2005 | Eckers et al. |

FOREIGN PATENT DOCUMENTS

| | | |
|---|---|---|
| DE | 101 02 219 A1 | 7/2002 |

OTHER PUBLICATIONS

French Search Report for French Application No. 04 07319, dated Feb. 16,2005.

*Primary Examiner*—David J Walczak
(74) *Attorney, Agent, or Firm*—Finnegan, Henderson, Farabow, Garrett & Dunner, LLP

(57) ABSTRACT

Various embodiments of a device for applying a substance to, for example, eyelashes and/or eyebrows are disclosed. The device may include a support extending along a longitudinal axis, and a first row of teeth and a second row of teeth integrally formed as a single piece with the support. Teeth in the first and second rows of teeth may extend from a common side of the support, and the first and second rows of teeth may extend over at least one fourth of a length of the support. At least two teeth may extend from the support in directions that are not parallel to one another. At least one of the first and second rows may include two teeth each extending, at least partially, on either side of a separation surface extending along that row.

65 Claims, 4 Drawing Sheets

DEVICE FOR APPLYING A SUBSTANCE

This application claims benefit under 35 U.S.C. § 119(e) of U.S. Provisional Application No. 60/587,489, filed on Jul. 14, 2004.

The present invention relates to devices for applying a substance. In particular, various exemplary embodiments of the present invention relate to devices for applying a cosmetic product to keratinous fibers (e.g., eyelashes or eyebrows). For example, an exemplary device consistent with the present invention may comprise a support extending along a longitudinal axis and a plurality of teeth integrally formed as a single piece with the support. The teeth may extend from a common side of the support. The term "cosmetic product" includes care products as well as makeup products.

There are various applicator devices for applying cosmetic products to eyelashes. For example, U.S. Pat. No. 6,581,610 discloses a device for applying a substance to eyelashes, including a container configured to contain the product and an applicator including at least one row of teeth. The at least one row of teeth may include a succession of consecutive teeth. Each tooth in the succession of teeth may include a root and a portion extending from the root. The roots of the consecutive teeth may be substantially aligned and the portions extending from the roots may be offset alternately on either side of a geometric separation surface.

U.S. Pat. No. 6,343,607 discloses a device for applying a substance to eyelashes. The device comprises a stem and an application element on an end of the stem. The applicator element comprises a base portion having a polygonal cross-section and a plurality of sides, and a plurality of projection members disposed on the polygonal base portion. At least two of the projection members extend away from the base portion substantially in continuation of different sides of the base portion and extend outward from the base portion in different directions from one another.

U.S. Pat. No. 4,660,582 discloses a mascara brush including fine teeth that all extend parallel to one another.

U.S. Pat. No. 4,422,986 discloses a method and apparatus for injection-molding mascara brushes. The molded brush includes teeth that are disposed in rows and that are strictly in alignment. The rows of teeth extend both parallel and perpendicular to the longitudinal axis of the brush.

Other devices enabling a substance to be applied to the eyelashes are also known from U.S. Pat. Nos. 6,412,496, 6,530,950, and 6,546,937.

There exists a need for further improving the performance of at least some of such application devices and the effects they produce. In particular, there exists a need to increase the number of application elements (e.g., teeth or bristles) in an applicator member without excessively increasing the dimensions of the applicator member or complicating its manufacturing process. The increased number of application elements may make it easier to apply a substance (e.g., makeup) to keratinous fibers (e.g., eyelashes or eyebrows), while still allowing the fibers to pass between the application elements.

Although the present invention may obviate one or more of the above-mentioned needs, it should be understood that some aspects of the invention might not necessarily obviate one or more of those needs.

In the following description, certain aspects and embodiments will become evident. It should be understood that the invention, in its broadest sense, could be practiced without having one or more features of these aspects and embodiments. It should be understood that these aspects and embodiments are merely exemplary.

In one aspect, as embodied and broadly described herein, the invention may include a device for applying a substance to eyelashes and/or eyebrows. The device may comprise a support extending along a longitudinal axis, and a first row of teeth and a second row of teeth integrally formed as a single piece with the support. Teeth in the first and second rows of teeth may extend from a common side of the support, and the first and second rows of teeth may extend over at least one fourth of a length of the support.

In some exemplary aspects, at least two teeth may extend from the support in directions that are not parallel to one another, and at least one of the first and second rows may comprise two teeth each extending, at least partially, on either side of a separation surface extending along said row.

The term "separation surface," as used throughout the description, including the claims, refers to an imaginary geometric construction defining a boundary about which alternating teeth may be disposed, at least partially, on either side thereof. An example of teeth arranged with such a "separation surface" includes a plurality of teeth disposed in a row with a separation surface passing through the mid-plane of the row, in which at least one of the teeth is disposed on a first side of the separation surface while another of the teeth is disposed on a second side of the separation surface, opposite to the first side. To illustrate another example, the separation surface may be the same as the geometric separation surface disclosed in U.S. Pat. No. 6,581,610. In accordance with the meaning of the term "separation surface" as used herein, the brush disclosed in U.S. Pat. No. 4,422,986 does not include any "separation surface;" instead, the teeth in each row of that brush are strictly in alignment without any "separation surface." Furthermore, the brush disclosed in U.S. Pat. No. 4,422,986 does not have any row of teeth that includes two teeth each extending, at least partially, on either side of a separation surface extending along the row.

According to another aspect of the invention, the first and second rows of teeth may extend substantially parallel to the longitudinal axis of the support.

The first and second rows of teeth may be connected to a common side (e.g., face) of the support, which may be substantially planar, for example. The support may be made with a relatively high number of teeth, while still permitting the eyelashes or eyebrows to pass between the teeth, and without significantly increasing the dimensions of the applicator member.

In some exemplary embodiments, the applicator member may produce effects similar to those produced by a brush. For example, the teeth of the applicator member may be suitable, in particular, for combing the eyelashes and eyebrows and/or for smoothing substance applied onto their surfaces.

In some aspects, at least three consecutive teeth of at least one of the first and second rows may have bases that are not in alignment. Alternatively or additionally, at least three consecutive teeth of at least one of the first and second rows may have bases that are substantially in alignment.

The term "substantially in alignment," as used throughout the description, including the claims, refers to an arrangement of teeth in which a portion of each of the bases of consecutive teeth is situated on a first side of a line passing through the bases of the consecutive teeth, and another portion of each of the bases of the consecutive teeth is situated on a second side of the line, opposite to the first side, where the line is substantially parallel to a longitudinal axis of the row. In particular, the line may be a straight line that passes through the centers of the bases of the consecutive teeth. Teeth having bases that are not in alignment may make the applicator member easier to manufacture.

In some exemplary aspects, the bases of the teeth of one of the first and second rows may optionally be superposed, at least partially, when the applicator member is observed from the side in a direction perpendicular to its longitudinal axis. Teeth having bases that are not superposed may also make the applicator member easier to manufacture.

The teeth may be arranged in numerous configurations depending upon, for example, the desired makeup effect.

According to another aspect, at least two consecutive teeth of at least one of the first and second rows may not be touching each other. Teeth that are not touching each other may provide more space between the teeth, and thereby may increase the quantity of substance that can be loaded onto the applicator member. Alternatively or additionally, at least two consecutive teeth of at least one of the first and second rows may be touching each other.

In an aspect, at least three consecutive teeth of at least one of the first and second rows may extend alternately, at least in part, on either side of the separation surface. In another aspect, at least two consecutive teeth of at least one of the first and second rows may extend in directions that are substantially parallel. In still another aspect, at least two consecutive teeth of at least one of the first and second rows may extend in directions that diverge from one another.

According to some aspects, at least two teeth of at least one of the first and second rows may comprise lengths that are different from one another. Of course, in another aspect, at least two teeth of at least one of the first and second rows may comprise lengths that are identical to each other.

In still another aspect, at least two teeth of at least one of the first and second rows may comprise shapes that are different from one another or that are identical. In some aspects, at least one tooth of at least one of the first and second rows may extend along a longitudinal axis that is rectilinear. Alternatively or additionally, at least one tooth of at least one of the first and second rows may extend along a longitudinal axis that is not rectilinear. In another aspect, at least one tooth of at least one of the first and second rows may comprise a generally tapering shape that tapers towards its free end.

In accordance with an aspect of the invention, at least two consecutive teeth of at least one of the first and second rows may be directed towards the distal and proximal ends of the support, respectively. In some exemplary aspects, the two consecutive teeth of at least one of the first and second rows may be crossed when the support is observed along a direction substantially perpendicular to the longitudinal axis of the support. The teeth may optionally touch at their crossover portion. In some exemplary embodiments, the portions of the teeth extending above the crossover portion may define a V-shaped channel.

In some aspects, at least two consecutive teeth of at least one of the first and second rows may each comprise at least one face (e.g., a substantially planar face). For example, at least two consecutive teeth of at least one of the first and second rows may each comprise cross-sections that are substantially semi-circular in shape. In another aspect, at least two consecutive teeth of at least one of the first and second rows may each comprise a substantially planar face facing towards the separation surface (e.g., inside of the row).

In another aspect, at least one of the first and second rows may extend along an axis that is rectilinear.

In still another aspect, the separation surface may be a mid-plane for the row.

According to some aspects, the teeth of the first and second rows may extend over more than half the length of the support. For example, the teeth of the first and second rows may extend over more than three fourths of the length of the support.

In one aspect, the device may include only two rows of teeth. Alternatively, the device may include more than two rows of teeth. When the device includes more than two rows of teeth, the rows other than the above-mentioned first and second rows may be disposed on the same side of the support as the first and second rows or on another side.

In another aspect, the teeth of at least one of the first and second rows may optionally extend parallel to a common direction.

According to some aspects of the invention, the teeth of the first row may extend substantially parallel to a first direction, and the teeth of the second row may extend substantially parallel to a second direction. The first and second directions may form between them an angle that may not be zero. In some exemplary embodiments, the angle may range from about 50 to about 60°. In particular, the angle may range from about 150 to about 45°. In some examples, the angle may be less than 90°.

In another aspect, the common side of the support from which the teeth of the first and second rows extend may be substantially planar, and a bisector of the angle may be substantially perpendicular to the common side. Alternatively, the common side of the support from which the teeth of the first and second rows extend may be substantially planar, and a bisector of the angle may intersect the common side at an angle that may not be perpendicular thereto.

In one aspect, at least one tooth of the first row may correspond to a tooth of the second row that may occupy substantially the same axial position along the support. In some exemplary embodiments, the two teeth that occupy substantially the same axial position along the support may touch each other.

According to another aspect, at least one tooth of one of the first and second rows may comprise a profile that is different from a profile of a tooth of the other of the first and second rows.

In still another aspect, at least one tooth of one of the first and second rows may comprise a length that is different from a length of a tooth of the other of the first and second rows.

In some aspects, two teeth in one of the first and second rows may extend in directions that form an angle therebetween. In an exemplary embodiment, two teeth in one of the first and second rows may extend in directions that form a first angle therebetween, and two teeth of the other of the first and second rows may extend in directions that form a second angle therebetween. The first and second angles may be equal or they may be different from one another. In some exemplary embodiments, at least one of the first and second angles may be zero.

According to one aspect, both the first and second rows may optionally have substantially the same number of teeth. By way of example only, each row of teeth may have about 20 to 50 teeth. In an exemplary embodiment, each row of teeth may have more than 30 teeth.

In another aspect, the teeth in each of the first and second rows may be evenly spaced along the longitudinal axis of the row. In still another aspect, the teeth in each of the first and second rows may be arranged in groups of two or more teeth. By way of example only, each group may include only two teeth. The distance between the teeth along the longitudinal axis of the row within a group may be less than a distance between two adjacent groups of teeth of said row.

According to some aspects, two groups of teeth each belonging to the first and second rows, respectively, may occupy substantially the same axial position along the support. Alternatively, the two groups of teeth may not occupy substantially the same axial position along the support. For example, at least one group of teeth belonging to one of the first and second rows may be axially offset relative to a corresponding group of teeth belonging to the other of the first and second rows. In particular, the groups of teeth may be disposed in a staggered configuration along the support.

In one aspect, the longitudinal axis of the support may be rectilinear. Alternatively, the longitudinal axis of the support may be curvilinear.

In another aspect, the teeth may be integrally molded with the support out of a plastic material. The plastic material may be elastomeric.

In still another aspect, at least one of the support and a tooth may comprise magnetic properties. By way of example only, the magnetic properties may be a result of a magnetic-particle filler that may be dispersed in the plastic material of the support and/or the tooth.

In yet still another aspect, at least one of the support and a tooth may be flocked.

According to one aspect, the applicator member (e.g., the support) may comprise a plurality of sides comprising teeth (e.g., each carrying an arrangement of teeth).

In some aspects, the support may be fastened to a first end of a stem. The stem may be connected to a handle at a second end opposite from the first end. The handle may be configured to close, in substantially leaktight manner, a receptacle containing the substance to be applied.

In another aspect, the device may comprise the receptacle, and the receptacle may comprise a wiper member, which may be adapted to wipe the stem and the applicator member. The support may have a curved portion that may facilitate passing of the support through the wiper member.

In still another aspect, the device may not include any metal. This may enable the device to be placed in a microwave oven.

In one aspect, the device may comprise a receptacle containing the substance to be applied. The substance may comprise at least one of a cosmetic product and a care product. For example, the substance may be mascara.

According to another aspect, at least two teeth of the first row may each extend, at least partially, on either side of a first separation surface extending along said first row, and at least two teeth of the second row may each extend, at least partially, on either side of a second separation surface extending along said second row. For example, the first and second separation surfaces may define an angle of less than 90° therebetween.

In a further aspect, the two teeth extending, at least partially, on either side of the separation surface may be arranged differently with respect to the separation surface. For example, one of the two teeth may be offset more from one side of the separation surface as compared to the other of the two teeth. In some examples, the two teeth may be consecutive teeth in the same row.

In yet another aspect, at least some teeth of at least one of the first and second rows may be spaced from a side edge of the common side that extends along the longitudinal axis of the support.

In an even further aspect, at least one of the first and second rows may comprise two teeth each extending, entirely, on either side of the separation surface.

In one more aspect, at least one of the two teeth extending, at least partially, on either side of the separation surface may have a thickness in a plane transverse to the longitudinal axis of the support, and a spacing between the two teeth extending, at least partially, on either side of the separation surface may be less than said thickness. In some examples, the distance between two consecutive teeth in a direction facing each other (i.e., when viewed in the direction of the longitudinal axis of the support) with a separation surface therebetween may not be greater than a thickness of each of the two consecutive teeth.

In still another aspect, each of the two teeth extending, at least partially, on either side of the separation surface may be not normal (e.g., not perpendicular) to the common side.

Some exemplary aspects of the invention may provide a device for applying a substance to the eyelashes and/or eyebrows, which may comprise a support extending along a longitudinal axis, and a first row of teeth and a second row of teeth formed integrally as a single piece with the support. The teeth may extend from a common side of the support. The first and second rows of teeth may extend over at least one fourth of a length of the support. At least one of the rows may comprise two teeth extending, at least in part, on either side of a separation surface extending along said row, and each of two consecutive teeth of at least one of the first and second rows may have a substantially planar face facing towards the inside of the row (e.g., facing toward the separation surface).

Another aspect of the invention may provide another device for applying a substance to eyelashes and/or eyebrows. The device may comprise a support extending along a longitudinal axis, and teeth integrally formed as a single piece with the support. The teeth may extend from a common face of the support and may present free ends that may be substantially in alignment along at least four lines that are substantially parallel to the longitudinal axis of the support.

Aside from the structural arrangements set forth above, the invention could include a number of other arrangements, such as those explained hereinafter. It is to be understood that both the foregoing description and the following description are exemplary.

The accompanying drawings, which are incorporated in and constitute a part of this specification, illustrate a number of non-limiting embodiments of the invention and together with the description, serve to explain the principles of the invention.

Figure 3:
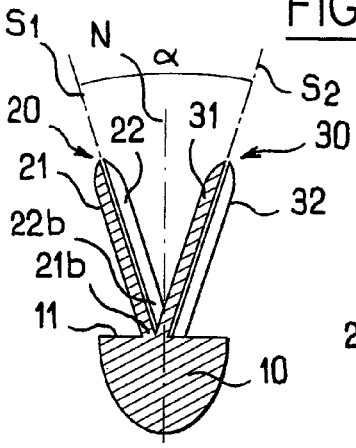
FIG. 3 is a cross-sectional view of the applicator member shown in FIG. 2 along the III-III plane.

FIGS. 9*a* to 9*l* are cross-sectional views of an applicator member, similar to FIG. 3, illustrating various exemplary arrangements of teeth.

Figure 9A:
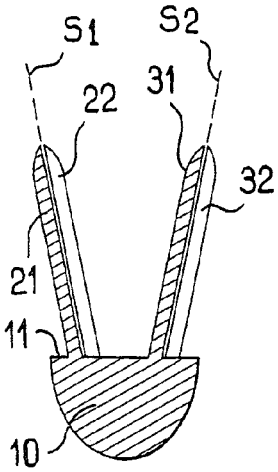
Figure 9B:
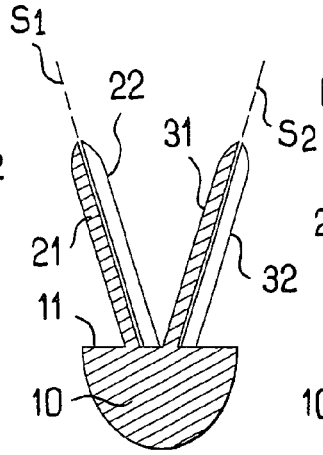
Figure 9C:
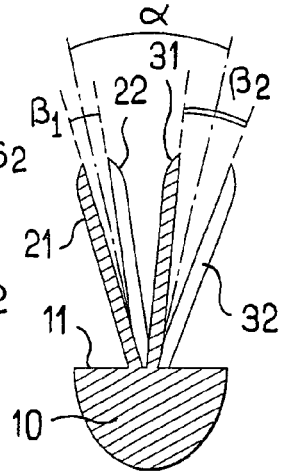
Figure 9D:
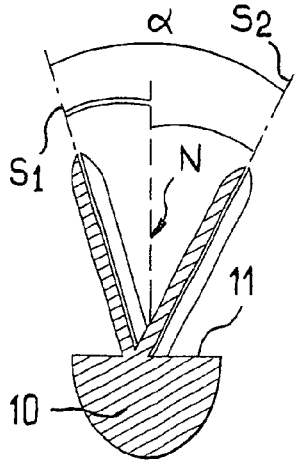
Figure 9E:
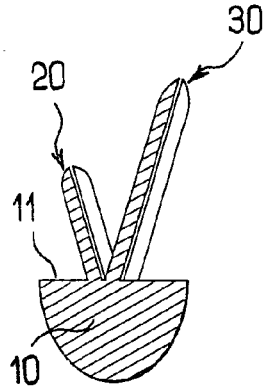
Figure 9F:
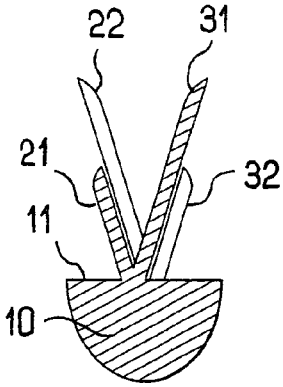
Figure 9G:
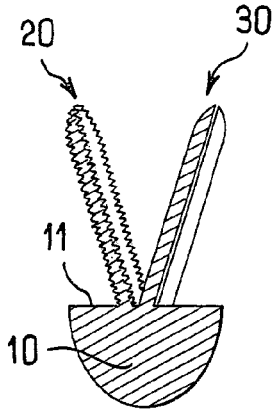
Figure 9H:
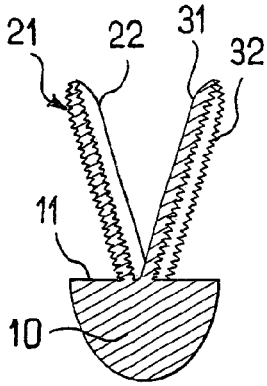
Figure 9I:
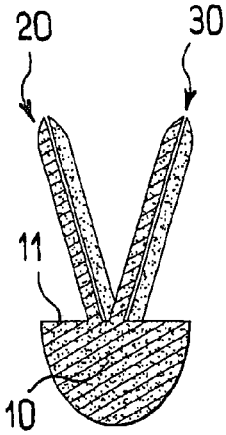
Figure 9J:
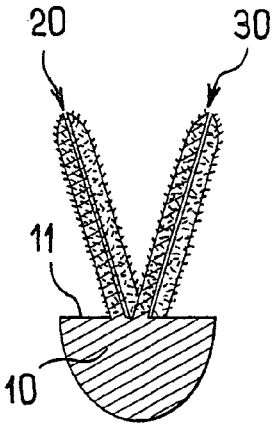
Figure 9K:
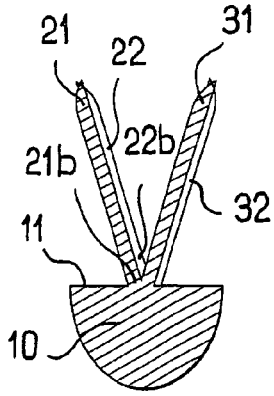
Figure 9L:
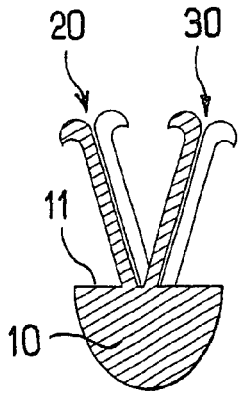
Figure 10A:
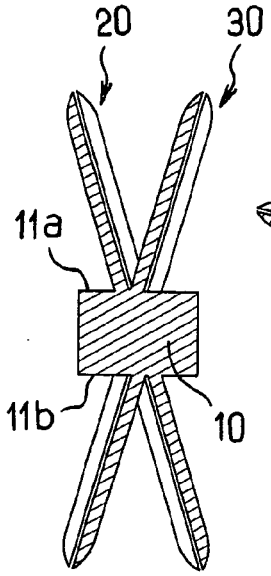
Figure 10B:
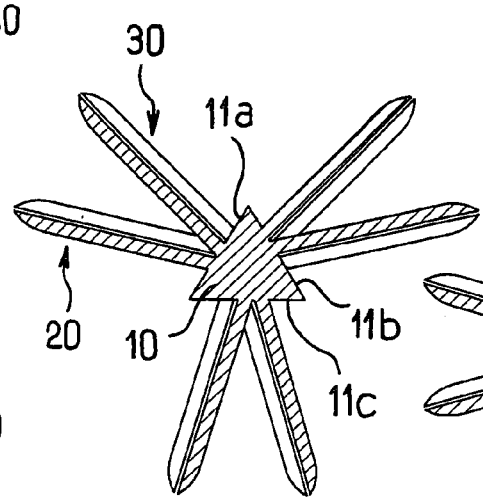
Figure 10C:
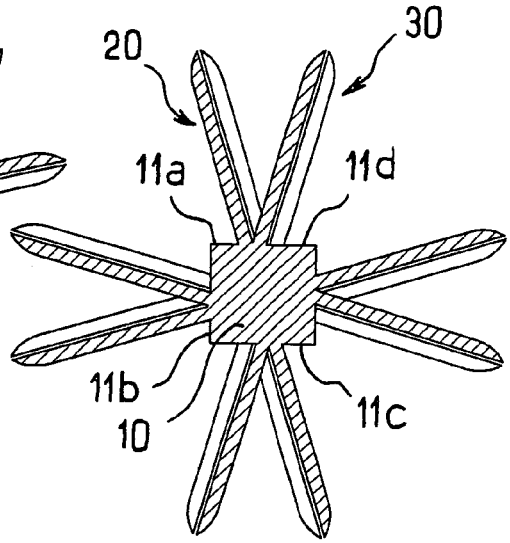

FIGS. 10*a* to 10*c* are cross-sectional views of an applicator member, similar to FIGS. 9*a* to 9*l*, illustrating various exemplary applicator members having a plurality of sides carrying rows of teeth.

Figure 11:
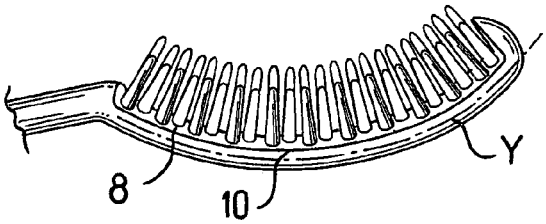

FIG. 11 is a diagrammatic view of an applicator member, according to another exemplary embodiment of the invention, illustrating a possibility that a support of the applicator member can be made curvilinear along its longitudinal axis.

Figure 7:
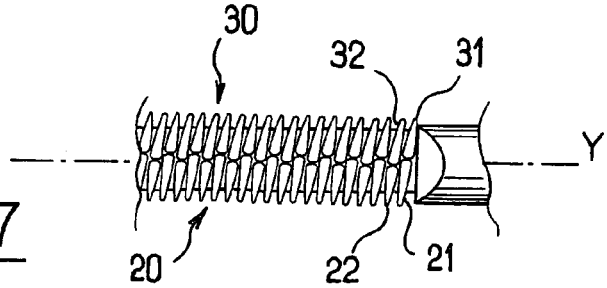
FIG. 7 is a fragmentary plan view of the applicator member shown in FIG. 2, as seen in the direction of the arrow VII.
Figure 12:
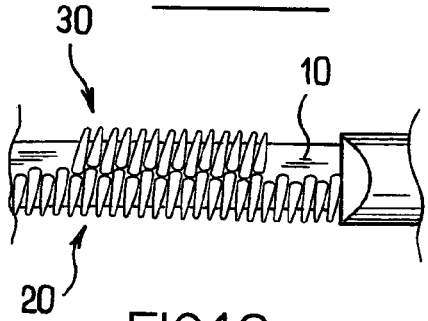

FIG. 12 is a fragmentary plan view of an applicator member, similar to FIG. 7, illustrating another exemplary embodiment, in which one of the rows has fewer teeth than the other row.

Figure 13:
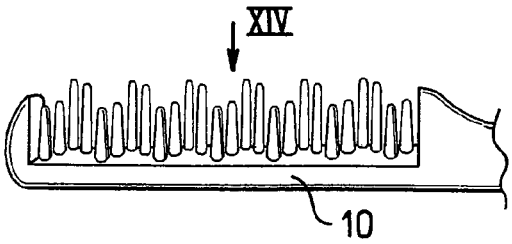

FIG. 13 is a diagrammatic side view of an applicator member, according to another exemplary embodiment of the invention, in which the teeth are arranged in groups.

Figure 14:
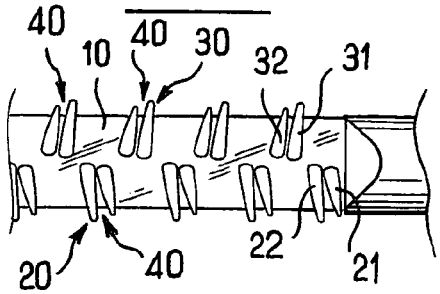

FIG. 14 is a fragmentary plan view of the applicator member shown in FIG. 13, as seen in the direction of the arrow XIV.

Figure 15:
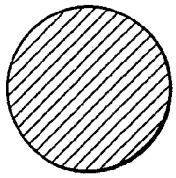

FIG. 15 is a cross-sectional view of a tooth at a circular section, according another exemplary embodiment of the invention.

Figure 16:
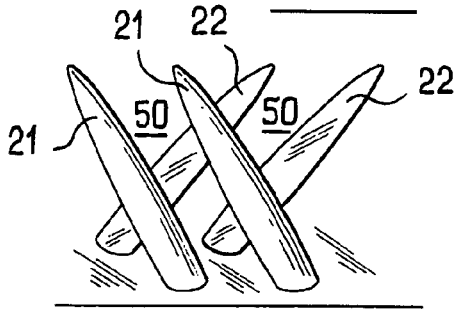

FIG. 16 is a diagrammatic, partial side view of an applicator member, illustrating an exemplary arrangement of teeth in a row of teeth according to another exemplary embodiment of the invention.

Reference will now be made in detail to the exemplary embodiments of the invention, examples of which are illustrated in the accompanying drawings. Wherever possible, the same reference numbers will be used throughout the drawings to refer to the same or like parts. It is to be understood that both the foregoing general description and the following detailed description are exemplary and explanatory only and are not restrictive of the invention, as claimed.

Figure 1:
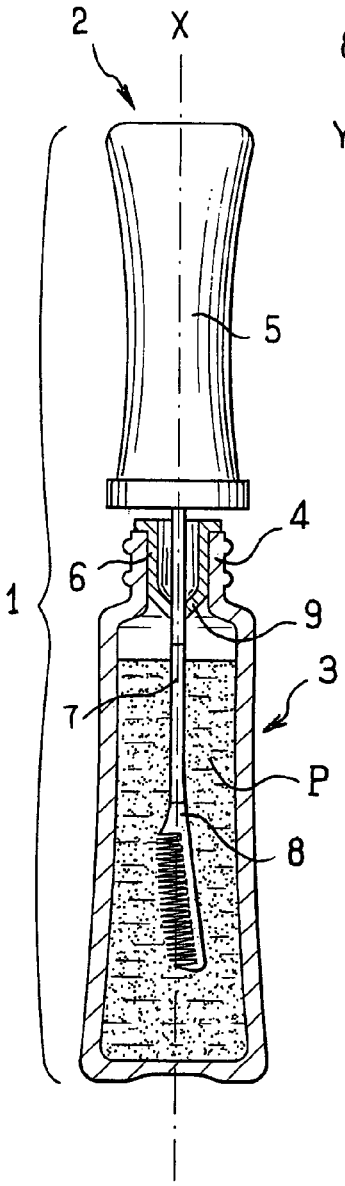
FIG. 1 is a diagrammatic, axial cross-sectional view of a device for applying a substance, according to an exemplary embodiment of the invention.

FIG. 1 shows a packaging and applicator device 1 for applying a substance to, for example, keratinous fibers (e.g., eyelashes or eyebrows), according an exemplary embodiment of the invention. The device may comprise an applicator 2 and a receptacle 3 configured to contain a substance P to be applied with the applicator 2 (e.g., mascara or care product).

In the exemplary embodiment shown in FIG. 1, the receptacle 3 may include a threaded neck 4, and the applicator 2 may include a closure cap 5 arranged to be screwed onto the neck 4, so as to close the receptacle 3 in a leaktight manner while it is not in use. The closure cap 5 may also constitute a handle for the applicator 2.

The applicator 2 may include a stem 7 having a longitudinal axis X. The longitudinal axis X of the stem 7 may be rectilinear and may coincide with the longitudinal axis of the receptacle 3 when the applicator 2 is placed on the receptacle 3. In an alternatively embodiment, the stem 7 may be non-rectilinear. For example, at least a portion of the stem 7 may form a bend. The stem 7 may be connected at its one end to the closure cap 5 and may include at the other end an applicator member 8.

The receptacle 3 may include a wiper member 6 that may be removably inserted into the neck 4 of the receptacle 3. The wiper member 6 may include a flexible lip 9 that may be configured to wipe the stem 7 and the applicator member 8 when the applicator 2 is being removed from the receptacle 3. For example, the flexible lip 9 may define an orifice having a diameter substantially equal to or slightly less than a diameter of the stem 42. In some exemplary embodiments, the lip 9 may comprise a plurality of lips that may be configured to split apart.

While, in the exemplary embodiment shown in FIG. 1, the stem 7 presents a circular cross-sectional shape, the stem 7 may present a flat or any other cross-sectional shape. In case the stem 7 presents a flat cross-sectional shape, the closure cap 5 may be fastened to the receptacle 3 in a manner other than by screw engagement in order to, for example, prevent breakage of the stem 7.

Where appropriate, the stem 7 may include an annularly constricted portion that may be configured to receive at least a portion of the lips 9 of the wiper member 6 when the applicator 2 is placed on the receptacle 3. This configuration may relieve at least part of the mechanical stress exerted onto the lips 9 of the wiper member 6 during storage. Alternatively or additionally, the wiper member 6 may include a block of foam.

As shown in FIG. 1, the applicator member 8 may include a support 10 that may extend along a longitudinal axis Y. The support 8 may comprise a substantially flat face 11 from which at least two rows 20, 30 of teeth may extend.

The rows of teeth (e.g., two rows) may be made integrally as a single piece with the support 10 by molding (e.g., injection-molding) a plastic material, for example. The plastic material may be relatively rigid or relatively soft. For example, the plastic material may comprise at least one of the following materials: styrene-ethylene-butylene-styrene (SEBS); silicone; ethylene-propylene terpolymer rubber (EPDM); nitrile; polyester; polyamide; polyethylene; vinyl elastomer; polyolefin such as polyethylene (PE) or polypropylene (PP); polystyrene (PS); polyethylene terephthalate (PET); polyoxymethylene (POM); polyamide (PA); and polymethyl methacrylate (PMMA). The materials listed above are exemplary only, and any other suitable material known in the art may be used alternatively or additionally. In some alternative embodiments, at least a portion of the applicator member 8 may be made by molding or machining non-plastic material (e.g., metallic material).

Figure 2:
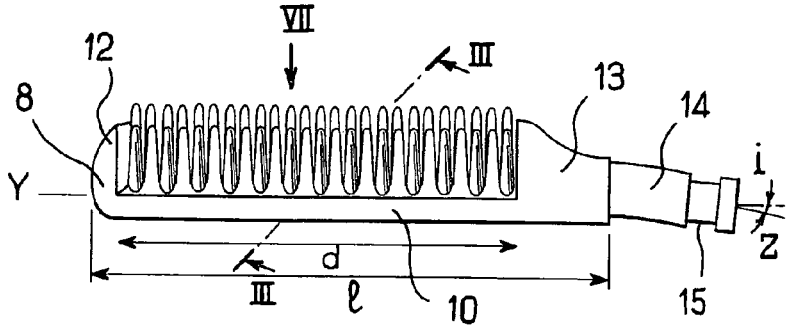
FIG. 2 is a partial diagrammatic view of the device shown in FIG. 1, illustrating an exemplary embodiment of an applicator member.

As shown in FIG. 2, the support 10 may include a distal portion 12 and a proximal portion 13. The distal portion 12 may be rounded towards the front so as to make it easier to, for example, place the applicator 2 back into the receptacle 3. The proximal portion 13 may be shaped (e.g., having a curved portion) so as to make it easier for the applicator member 8 to pass through the wiper member 6 or the neck 4 of the receptacle 3 while the applicator 2 is being removed from the receptacle 3.

The support 10 may include a cylindrical endpiece 14 that may extend from the proximal end of the support 10 along an axis Z. The endpiece 14 may be configured to engage with a portion of the stem 7. For example, in the exemplary embodiment shown in FIG. 2, the endpiece 14 may include an annular groove 15 that may be configured to be snap-fastened to a corresponding engagement mechanism (e.g., housing, clasp, etc.) provided at the distal end of the stem 7. Of course, the support 10 may be fastened to the stem 7 by any other connecting mechanism, such as, for example, by adhesive, by heat-sealing, or by clamping. In some exemplary embodiments, the support 10 may be made integrally as a single piece with the stem 7 by, for example, molding a suitable material.

In the exemplary embodiment shown in FIG. 2, the axis Z of the endpiece 14 may form an angle i (e.g., of a few degrees) with the longitudinal axis Y of the support 10. This arrangement may make the applicator 2 more ergonomic with the angle i being formed at the proximal end of the support 10, remote from the rows of teeth 20, 30.

At least one row of teeth 20, 30 in the support 10 may extend over a distance d that may correspond to more than one fourth (¼) of the visible length l of the support 10. In some exemplary embodiments, as shown in FIG. 2, the distance d may be greater than three fourth (¾) of the distance l. Naturally, the difference (i.e., l-d) may correspond substantially to the sum of the dimensions of the distal and proximal portions 12, 13 along the axis Y.

In some exemplary embodiments, at least two teeth in a row may extend in directions that are not parallel.

Still in the embodiment under consideration, each of the rows of teeth 20, 30 may extend in the support 10 along a longitudinal axis W. The axis W may be substantially rectilinear and parallel to the longitudinal axis Y of the support 10. Any other configurations may be possible. For example, in an alternative embodiment, the rows of teeth 20, 30 may extend obliquely relative to the longitudinal axis Y of the support 10.

Figure 4:
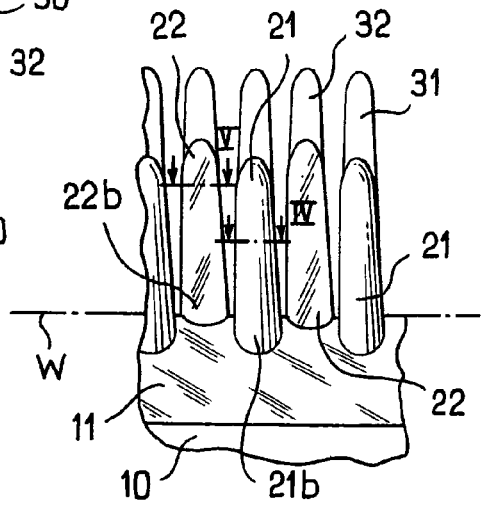
FIG. 4 is an exploded, partial schematic view of the applicator member shown in FIG. 2.

Referring now to FIGS. 3 and 4, each row of teeth 20, 30 may comprise alternating teeth (i.e., teeth 21 and 22 for row 20, and teeth 31, 32 for row 30). By way of example only, each row 20, 30 may include more than 30 teeth. In an exemplary embodiment, each row 20, 30 may include about 35 teeth.

Each row of teeth 20, 30 may define a respective separation surface S1, S2. For example, two consecutive teeth 21, 22 in row 20 may be respectively disposed, at least partially, on each side of the separation surface S1. Similarly, the two consecutive teeth 31, 32 of row 30 may be respectively disposed, at least partially, on each side of the separation surface S2.

The separation surfaces S1, S2 may form between them an angle $\alpha$ (e.g., of about 40°), as shown in FIG. 3. A normal axis N that is perpendicular to the face 11 may substantially bisect the angle $\alpha$, as can be seen in FIG. 3.

In the exemplary embodiment shown in FIG. 3, the teeth 21, 22 in row 20 may comprise bases 21*b*, 22*b* that may not be in alignment since they may be respectively situated entirely on opposite sides with respect to the separation surface S1. Similarly, the teeth 31, 32, whose respective bases may not be in alignment, may be situated entirely on opposite sides with respect to the separation surface S2.

As shown in FIG. 4, the bases 21*b*, 22*b* of the teeth 21, 22 may not overlap when the applicator member 8 is observed from the side (i.e., in a direction that is perpendicular to the longitudinal axis Y of the support 10. The same may apply for the teeth 31, 32 in row 30.

According to another exemplary embodiment, as shown in FIG. 7, each tooth 21 of row 20 may be associated with a corresponding tooth 31 of row 30, in such a way that the tooth 31 of row 30 may be aligned in substantially the same axial position as that of the tooth 21 of row 30 along the axis Y of the support. The same may apply for each tooth 22 of row 20 and the tooth 32 of row 30.

In some exemplary embodiments, the bases 21*b* of the teeth 21 in row 20 and the bases of the teeth 31 in row 30 may touch each other when viewed in the direction of the longitudinal axis Y of the support 10, as shown in FIG. 3. The teeth 21 of row 20 and the teeth 31 of row 30 may form substantially a V-shape that may open outwardly. The same may apply for the teeth 22 of row 20 and teeth 32 of row 30.

Figure 5:
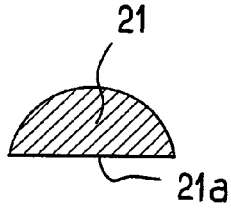
FIGS. 5 and 6 are cross-sectional views of two consecutive teeth shown in FIG. 4 along the V-V and VI-VI planes, respectively, according to an exemplary embodiment of the invention.
Figure 6:
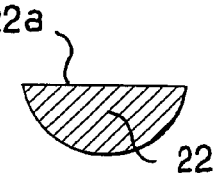

The teeth 21, 22 in row 20 may extend along their longitudinal axes that may be rectilinear. The longitudinal axes of the teeth 21, 22 may not be parallel with respect to the face 11 of the support 10. Each of the teeth 21, 22 may include a planar face 21*a*, 22*a*. For example, as shown in FIGS. 5 and 6, each of the teeth 21, 22 may have a semi-circular cross-section. The planar faces 21*a*, 22*a* of the teeth 21, 22 may face the separation surface S1 (e.g., towards the inside of row 20). The same may apply for the teeth 31, 32 of row 30.

Figure 8:
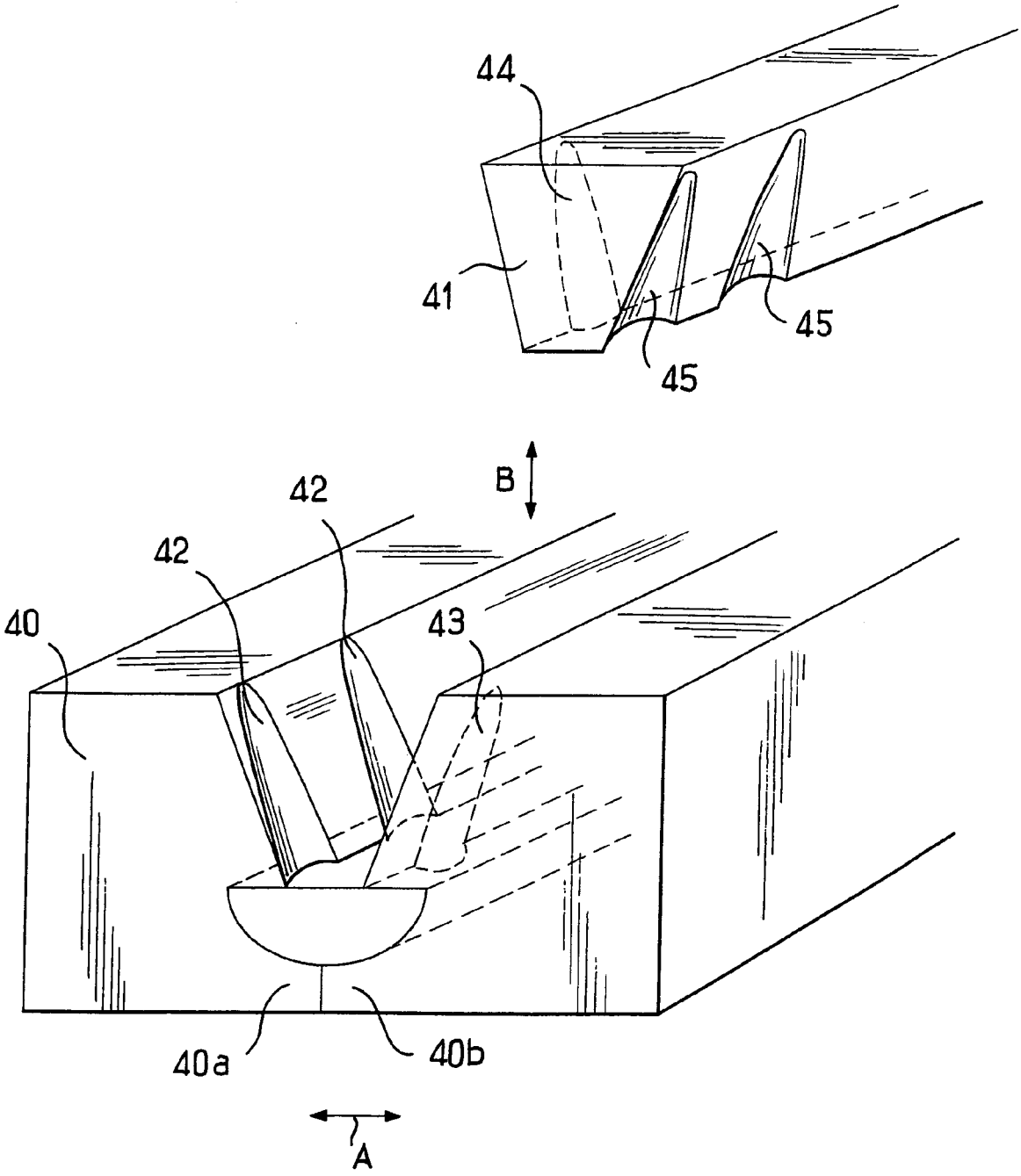
FIG. 8 is a diagrammatic, partial perspective view of a mold suitable for making the applicator member of FIG. 2.

With reference to FIG. 8, an exemplary device and method for manufacturing the application member 8, according to an exemplary embodiment of the invention, will be described. The particular molding device and method described herein is exemplary only and should by no means be limiting the scope of the present invention. For example, any suitable device or method known in the art may be used alternatively or additionally.

The applicator member 8 may be made by a molding process. According to an exemplary embodiment, a mold used in the molding process may comprise a bottom block 40 and a top block 41 configured to mate with the bottom block 40 to form a molding space therebetween in the form of at least a portion of the applicator member 8, as shown in FIG. 8.

The bottom block 40 may comprise a plurality of separable portions. For example, as shown in FIG. 8, the bottom block 40 may comprise a first portion 40*a* and a second portion 40*b* that may move apart relative from each other in the direction of arrow A. The top block 41 may be assembled with the bottom block 40 by moving along the direction of arrow B.

The bottom block 40 may include a plurality of cavities 42 for forming the teeth 21 of row 20 and a plurality of cavities 43 for forming the teeth 32 of row 30. The top block 41 may include a plurality of cavities 44 for forming the teeth 22 of row 20 and a plurality of cavities 45 for forming the teeth 31 of row 30. As shown in FIG. 8, the cavities 44, 45 in the top block 41 may be positioned between the cavities 42, 43 of the bottom block 40, respectively, when the top block 41 and the bottom block 40 are assembled (e.g., when the mold is closed).

When the top block 41 is axially displaced along the direction of arrow B to mate with the bottom block 40, the cavities 42, 44 may be aligned alternately. It may then be possible to make an applicator member 8 comprising at least one row of teeth with bases that are in alignment and that extend alternately in opposite directions with respect to a separation surface.

To use the device 1 shown in FIG. 1, according to some exemplary embodiments of the invention, a user may unscrew the closure cap 5 and remove the applicator member 8 from the receptacle 3. Once the applicator member 8 has passed through the wiper member 6 to wipe off an excessive amount of substance from the stem 7 and the applicator member 8, an appropriate amount of substance P may remain between the rows 20, 30 of teeth, and between the teeth of the rows, and may be applied to, for example, eyelashes or eyebrows of the user. The relatively high number of teeth and their disposition on the applicator member 8 may enhance the application performance of the applicator member 8 on the eyelashes or eyebrows.

The invention is not limited to the embodiment described above, and the characteristics and/or features of the various different embodiments may be combined. For example, it may be possible to modify the positioning of the teeth 20, 21, 31, 32 on the support 10. For example, the rows 20, 30 may be spaced apart from one another, as shown in FIGS. 9*a* and 9*b*. In these exemplary embodiments, none of the teeth 21, 22 from one row 20 may not touch a tooth 31, 32 from the other row 30.

Moreover, in the exemplary embodiments described above with reference to FIGS. 1 to 7, the teeth 21, 22 of row 20 may extend parallel to a first direction, and the teeth 31, 32 of row 30 may extend parallel to a second direction that is different from the first direction. The invention should not be limited to this exemplary arrangement. Various alternative arrangements may be possible as described herein.

For example, in an exemplary embodiment, the teeth in each row may diverge away from the separation surface S1, S2. For example, as shown in FIG. 9*c*, the teeth 21, 22, 31, 32 may diverge away from the separation surface S1, S2 with angles $\beta$1, $\beta$2. FIG. 9*c* also shows a possibility of having the angles $\beta$1, $\beta$2 that are different from one another. In this particular embodiment, the bisector of the angle $\alpha$ between the bisectors of the angles $\beta$1 and $\beta$2 may or may not be normal to the face 11 of the support 10.

FIG. 9*d* shows a possibility of the bisector of the angle α, formed between the separation surfaces S1, S2 of rows 20 and 30, not coinciding with a normal axis N perpendicular to the face 11 of the support 10.

According to some exemplary embodiments, FIG. 9*e* shows another variant embodiment in which the teeth in one row (e.g., row 20) present a length that may be different from that of the teeth in the other row (e.g., row 30).

FIG. 9*f* shows a possibility of the teeth 21, 22 of at least one row presenting heights that may be different from one another, according to another exemplary embodiment. In the particular embodiment shown in FIG. 9*f*, each of the rows 20, 30 may present teeth 21, 22, 31, 32 having heights that are different from one another. By way of example only, the teeth 21 may be made shorter than the teeth 22, and the teeth 31 may be made longer than the teeth 32.

FIG. 9*g* shows a possibility of having at least one of the teeth that may comprise a portion in relief, according to still another exemplary embodiment. For example, at least one tooth may comprise, at least partially, ridges resulting from molding or roughness linked to, for example, the presence of a filler in the plastic material.

In the exemplary embodiment shown in FIG. 9*h*, each of the rows 20, 30 may present teeth having portions in relief that are different from one another.

FIG. 9*i* shows a possibility of making the applicator member 8 with a filled plastic material, according to another exemplary embodiment of the invention. For example, the applicator member 8 may include magnetic particles (e.g., including magnetizable and/or magnetized material). The magnetic field created by such particles may, for example, have an advantageous effect on the eyelashes or eyebrows and/or may interact with magnetic fibers that may be present in the substance.

In an exemplary embodiment, at least portion of the applicator member 9 may comprise flocking. By way of example only, the flocking may extend over the length of the teeth only.

According to another exemplary embodiment, FIG. 9*k* shows a possibility of having the teeth 21, 22, 31, 32 of each row that may have bases 21*b*, 22*b* that may be in alignment (e.g., at least partially overlapping).

In some exemplary embodiments, the teeth may include a cross-sectional shape that may not be semi-circular. For example, as shown in FIG. 9*k*, a portion of the teeth may have a circular cross-sectional shape. Any other cross-sectional shape may be possible.

In still another exemplary embodiment, the teeth may have, at their free ends, a particular shape (e.g., portions in relief). For example, the free ends of the teeth may comprise a hook-shaped portion, as shown in FIG. 9*l*. The hook-shaped portion may be capable of extending transversely or parallel to the longitudinal axis of the support 10.

In accordance with various exemplary embodiments, the applicator member 8 may comprise a plurality of faces 11*a*, 11*b*, 11*c*, 11*d*, as shown in FIGS. 10*a* to 10*c*. Each of the faces may carry a respective arrangement of teeth.

For example, FIG. 10*a* shows an applicator member including two opposite faces 11*a*, 11*b*. Each face carries two rows of teeth 20, 30. The rows of teeth 20, 30 may be arranged according to any of the exemplary embodiments described above.

In the exemplary embodiment shown in FIG. 10*b*, the support 10 may include three faces 11*a*, 11*b*, 11*c*. Each face may carry two or more rows of teeth arranged according to any of the exemplary embodiments described above. The support 10 may have four faces 11*a*, 11*b*, 11*c*, 11*d*, as shown in FIG. 10*c*, and each face may carry two or more rows of teeth arranged according to any of the exemplary embodiments described above. It should be understood that the support 10 may include more than four faces.

According to still another exemplary embodiment, the support 10 may have a longitudinal axis Y that is not rectilinear. For example, the longitudinal axis Y may be curvilinear with the teeth being situated, for example, on the concave side of the support 10, as shown in FIG. 11. Alternatively, the teeth may be situated on the convex side of the support 10.

The rows 20, 30 may have different numbers of teeth. For example, as shown in FIG. 12, one of the rows 30 may be shorter (i.e., has smaller number of teeth) than the other row 20.

In some exemplary embodiments, the teeth in each row 20, 30 may be arranged in groups 40 of teeth. For example, as shown in FIGS. 13 and 14, the teeth 21, 22 of row 20 and the teeth 31, 32 of row 30 may be grouped in pairs 40. The pairs 40 of teeth may be disposed in a staggered configuration, for example, as best shown in FIG. 14.

According to another exemplary embodiment, the teeth in one of the rows (e.g., the teeth 21, 22 in row 20) may extend alternately towards the distal and the proximal ends of the support 10, respectively. The same configuration may apply for the teeth 31, 32 in row 30. In this particular embodiment, V-shaped channels 50 may be formed between the top portions of crossed pairs of teeth 21, 22.

The teeth 21, 22 that are crossed may optionally touch at their crossover portion. The teeth 21, 22 may be crossed along all, or only part, of the length of the support 10.

Where appropriate, two crossed teeth 21, 22 may be directed outwards or inwards relative to a mid-plane containing the longitudinal axis that is perpendicular to the face of the support 10. When moving along a row, at least two consecutive pairs of two crossed teeth may be inclined inwards or outwards relative to the mid-plane. Alternatively, the pairs may be inclined inwards and outwards in alternation.

In some exemplary embodiments, the teeth may be grouped in some way other than in pairs. Moreover, the distance between the groups within the same row may optionally be the same. For example, the distance between the groups may be greater than the distance between the teeth within the group.

Throughout the description, including in the claims, the term "comprising a" should be understood as being synonymous with the term "comprising at least one" unless specified to the contrary.

Although the present invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A device for applying a substance to eyelashes and/or eyebrows, the device comprising:

a support extending along a longitudinal axis; and a first row of teeth and a second row of teeth integrally formed as a single piece with the support, teeth in the first and second rows of teeth extending from a common side of the support, the first and second rows of teeth extending over at least one fourth of a length of the support, wherein at least two teeth extend from the support in directions that are not parallel to one another, wherein at least one of the first and second rows comprises two teeth each extending, at least partially, on either side of a separation surface extending along said row, and wherein at least three consecutive teeth of at least one of the first and second rows extend alternately, at least in part, on either side of the separation surface.

2. A device according to claim 1, wherein the first and second rows of teeth extend substantially parallel to the longitudinal axis of the support.

3. A device according to claim 1, wherein at least three consecutive teeth of at least one of the first and second rows have bases that are not in alignment.

4. A device according to claim 1, wherein at least three consecutive teeth of at least one of the first and second rows have bases that are substantially in alignment.

5. A device according to claim 1, wherein at least two consecutive teeth of at least one of the first and second rows are not touching each other.

6. A device according to claim 1, wherein at least two consecutive teeth of at least one of the first and second rows are touching each other.

7. A device according to claim 1, wherein at least two consecutive teeth of at least one of the first and second rows extend in directions that are substantially parallel.

8. A device according to claim 1, wherein at least two consecutive teeth of at least one of the first and second rows extend in directions that diverge from one another.

9. A device according to claim 8, wherein at least two consecutive teeth of at least one of the first and second rows are directed towards the distal and proximal ends of the support, respectively.

10. A device according to claim 9, wherein said two consecutive teeth of at least one of the first and second rows are crossed when the support is observed along a direction substantially perpendicular to the longitudinal axis of the support.

11. A device according to claim 1, wherein at least two teeth of at least one of the first and second rows comprise lengths that are different from one another.

12. A device according to claim 1, wherein at least two teeth of at least one of the first and second rows comprise shapes that are different from one another.

13. A device according to claim 1, wherein at least one tooth of at least one of the first and second rows extends along a longitudinal axis that is rectilinear.

14. A device according to claim 1, wherein at least one tooth of at least one of the first and second rows extends along a longitudinal axis that is not rectilinear.

15. A device according to claim 1, wherein at least one tooth of at least one of the first and second rows comprises a generally tapering shape that tapers towards its free end.

16. A device according to claim 1, wherein at least one of the first and second rows extends along an axis that is rectilinear.

17. A device according to claim 1, wherein the separation surface is a mid-plane for the respective row.

18. A device according to claim 1, wherein the teeth of the first and second rows extend over more than half the length of the support.

19. A device according to claim 1, wherein the teeth of the first and second rows extend over more than three fourths of the length of the support.

20. A device according to claim 1, wherein the teeth of at least one of the first and second rows extend parallel to a common direction.

21. A device according to claim 1, wherein each of at least two consecutive teeth of at least one of the first and second rows comprises cross-sections that are substantially semi-circular.

22. A device according to claim 1, wherein each of at least two consecutive teeth of at least one of the first and second rows each comprises a substantially planar face facing towards the separation surface.

23. A device according to claim 1, wherein the device includes only two rows of teeth.

24. A device according to claim 1, wherein the device includes more than two rows of teeth.

25. A device according to claim 1, wherein the teeth of the first row extend substantially parallel to a first direction, and the teeth of the second row extend substantially parallel to a second direction, and wherein the first and second directions form between them an angle that is not zero.

26. A device according to claim 25, wherein the angle ranges from about 5° to about 60°.

27. A device according to claim 25, wherein the angle ranges from about 15° to about 45°.

28. A device according to claim 25, wherein the common side of the support from which the teeth of the first and second rows extend is substantially planar, and wherein a bisector of the angle is substantially perpendicular to the common side.

29. A device according to claim 25, wherein the common side of the support from which the teeth of the first and second rows extend is substantially planar, and wherein a bisector of the angle intersects the common side at an angle that is not perpendicular thereto.

30. A device according to claim 1, wherein the common side of the support from which the teeth of the first and second rows extend is substantially planar.

31. A device according to claim 1, wherein at least one tooth of one of the first and second rows comprises a profile that is different from a profile of a tooth of the other of the first and second rows.

32. A device according to claim 1, wherein at least one tooth of one of the first and second rows comprises a length that is different from a length of a tooth of the other of the first and second rows.

33. A device according to claim 1, wherein two teeth in one of the first and second rows extend in directions that form an angle therebetween.

34. A device according to claim 1, wherein two teeth in one of the first and second rows extend in directions that form a first angle therebetween, and wherein two teeth of the other of the first and second rows extend in directions that form a second angle therebetween.

35. A device according to claim 34, wherein the first and second angles are different from one another.

36. A device according to claim 1, wherein both the first and second rows have substantially the same number of teeth.

37. A device according to claim 1, wherein the teeth in each of the first and second rows are arranged in groups, and wherein two groups of teeth each belonging to the first and second rows, respectively, occupy substantially the same axial position along the support.

38. A device according to claim 37, wherein each group includes only two teeth.

39. A device according to claim 1, wherein the teeth of the rows are arranged in groups, and wherein at least one group belonging to one of the first and second rows is axially offset relative to a corresponding group belonging to the other of the first and second rows.

40. A device according to claim 39, wherein the groups are disposed in a staggered configuration along the support.

41. A device according to claim 1, wherein at least one tooth of the first row corresponds to a tooth of the second row that occupies substantially the same axial position along the support.

42. A device according to claim 41, wherein the two teeth that occupy substantially the same axial position along the support touch each other.

43. A device according to claim 1, wherein the longitudinal axis of the support is rectilinear.

44. A device according to claim 1, wherein the longitudinal axis of the support is curvilinear.

45. A device according to claim 44, wherein the teeth are integrally molded with the support out of a plastic material.

46. A device according to claim 45, wherein the plastic material is elastomeric.

47. A device according to claim 1, wherein at least one of the support and a tooth comprises magnetic properties.

48. A device according to claim 1, wherein at least one of the support and a tooth is flocked.

49. A device according to claim 1, wherein the support comprises a plurality of sides comprising teeth.

50. A device according to claim 1, wherein the support has a curved portion that facilitates passing of the support through a wiper member.

51. A device according to claim 1, wherein the support is fastened to a first end of a stem.

52. A device according to claim 51, wherein the stem is connected to a handle at a second end opposite from the first end.

53. A device according to claim 52, wherein the handle is configured to close, in substantially leaktight manner, a receptacle containing the substance to be applied.

54. A device according to claim 53, further comprising the receptacle, wherein the receptacle comprises a wiper member.

55. A device according to claim 1, wherein said device does not include any metal.

56. A device according to claim 1, further comprising a receptacle containing the substance to be applied.

57. A device according to claim 56, wherein the substance comprises at least one of a cosmetic product and a care product.

58. A device according to claim 56, wherein the substance is mascara.

59. A device according to claim 1, wherein at least two teeth of the first row each extend, at least partially, on either side of a first separation surface extending along said first row, and wherein at least two teeth of the second row each extend, at least partially, on either side of a second separation surface extending along said second row.

60. A device according to claim 59, wherein the first and second separation surfaces define an angle of less than 90° therebetween.

61. A device according to claim 1, wherein said two teeth extending, at least partially, on either side of the separation surface are arranged differently with respect to the separation surface.

62. A device according to claim 1, wherein at least some teeth of at least one of the first and second rows are spaced from a side edge of the common side that extends along the longitudinal axis of the support.

63. A device according to claim 1, wherein at least one of the first and second rows comprises two teeth each extending, entirely, on either side of the separation surface.

64. A device according to claim 1, wherein at least one of the two teeth extending, at least partially, on either side of the separation surface has a thickness in a plane transverse to the longitudinal axis of the support and wherein a spacing between said two teeth extending, at least partially, on either side of the separation surface is less than said thickness.

65. A device according to claim 1, wherein each of said two teeth extending, at least partially, on either side of the separation surface is not normal to the common side.

* * * * *